US008056681B2

(12) United States Patent
Fukuda et al.

(10) Patent No.: US 8,056,681 B2
(45) Date of Patent: Nov. 15, 2011

(54) STACKER CRANE AND WEIGHT REDUCTION METHOD FOR MAST OF THE STACKER CRANE

(75) Inventors: Isao Fukuda, Fushimi-ku (JP); Satoshi Kamide, Inuyama (JP)

(73) Assignee: Murata Machinery, Ltd., Kyoto-shi, Kyoto (JP)

( * ) Notice: Subject to any disclaimer, the term of this patent is extended or adjusted under 35 U.S.C. 154(b) by 643 days.

(21) Appl. No.: 12/202,688

(22) Filed: Sep. 2, 2008

(65) Prior Publication Data

US 2009/0057066 A1 Mar. 5, 2009

(30) Foreign Application Priority Data

Sep. 3, 2007 (JP) ..... 2007-227662

(51) Int. Cl.
*B66B 9/16* (2006.01)
*B66F 9/07* (2006.01)

(52) U.S. Cl. ..... 187/244; 414/279; 414/281; 212/316

(58) Field of Classification Search ..... 187/244; 414/279, 281, 282, 659, 663, 664, 671; 212/316, 212/319; *B66F 9/07, 9/08; B66C 17/00; B65G 63/02; B66B 9/16*

See application file for complete search history.

(56) References Cited

U.S. PATENT DOCUMENTS

| | | | | |
|---|---|---|---|---|
| 6,467,582 | B1 * | 10/2002 | Nakashima et al. | 187/244 |
| 2002/0017433 | A1 * | 2/2002 | Nakashima et al. | 187/249 |
| 2002/0039527 | A1 * | 4/2002 | Kamide | 414/279 |

FOREIGN PATENT DOCUMENTS

| | | | | |
|---|---|---|---|---|
| JP | 2-37112 | U | | 3/1990 |
| JP | 6-67412 | U | | 9/1994 |
| JP | H6-67412 | U | | 9/1994 |
| JP | 7-112805 | A | | 5/1995 |
| JP | 08081006 | A | * | 3/1996 |
| JP | 2006-1725 | A | | 1/2006 |
| JP | 2008074541 | A | * | 4/2008 |

OTHER PUBLICATIONS

Notification of Reason for Refusal dated Aug. 3, 2009 (Dispatch date), issued in corresponding Japanese Patent Application No. 2007-227662.

* cited by examiner

*Primary Examiner* — Michael Mansen
*Assistant Examiner* — Stefan Kruer
(74) *Attorney, Agent, or Firm* — Westerman, Hattori, Daniels & Adrian, LLP

(57) ABSTRACT

A mast includes two support columns each having nonuniform strength in a height direction. Both of upper and lower end portions of the mast have the highest strength, intermediate portions of the mast have the intermediate strength, and shoulder portions of the mast, between the central portion and both of the upper and the lower end portions, have the lowest strength.

2 Claims, 5 Drawing Sheets

STACKER CRANE AND WEIGHT REDUCTION METHOD FOR MAST OF THE STACKER CRANE

TECHNICAL FIELD

The present invention relates to a stacker crane, and in particular, relates to a method of reducing the weight of a mast.

BACKGROUND OF THE INVENTION

Japanese Utility Model Patent Publication No. 6-67412 discloses a technique of reducing the strength of a mast of a stacker crane from a lower position to an upper position. The inventors studied to achieve weight reduction of the stacker crane, and to realize structure which makes it possible to reduce the weight while supporting the horizontal stress applied to the mast. As a result, the inventors arrived at the present invention.

An object of the present invention is to reduce the weight of a mast of a stacker crane.

Another object of the present invention is to provide a guide for elevation and lowering of an elevation frame using a mast formed by joining parts having different cross sections.

According to the present invention, a stacker crane includes lower and upper vehicles each having a travel motor, and a mast having nonuniform strength along a height direction. The mast is provided between the lower vehicle and the upper vehicle. The mast includes upper and lower end portions, and a central portion.

The central portion of the mast has low strength in comparison with both of the upper and lower end portions of the mast.

Preferably, the nonuniform strength of the mast is determined as:

the upper and lower end portions>the central portion in the height direction>an intermediate portion between the lower end portion and the central portion, and an intermediate portion between the upper end portion and the central portion.

Further, preferably, a surface of the mast facing an elevation frame from the lower end portion to the upper end portion is placed on a same plane, and at least the intermediate portions are made up of a plurality of hollow pipes to place both side surfaces of the mast from the lower end portion to the upper end portion, as viewed from the elevation frame, on the same planes, respectively.

In the present invention, a stacker crane includes lower and upper vehicles each having a travel motor, and a mast having nonuniform strength along a height direction. The mast is provided between the lower vehicle and the upper vehicle. The mast includes upper and lower end portions, and a central portion.

The central portion of the mast is formed to have low strength in comparison with both of the upper and lower end portions of the mast. In this manner, the weight of the mast is reduced.

In the present invention, the mast has the nonuniform strength in the height direction in correspondence with the stress distribution applied to the mast. In this structure, weight reduction of the mast is achieved, and the stacker crane can travel at high speed easily. Further, in the case where the surface of the mast facing the elevation frame is placed on the same plane from the lower end portion to the upper end portion, while the strength of the mast changes in the height direction, the elevation frame can be guided easily. Further, in the case where the narrow intermediate portions of the mast are made up of a plurality of hollow pipes, both side surfaces of the mast are aligned on the same planes from lower end portion to the upper end portion, respectively, to guide the elevation frame along the side surfaces of the mast easily.

DESCRIPTION OF THE NUMERALS

Figure 1:
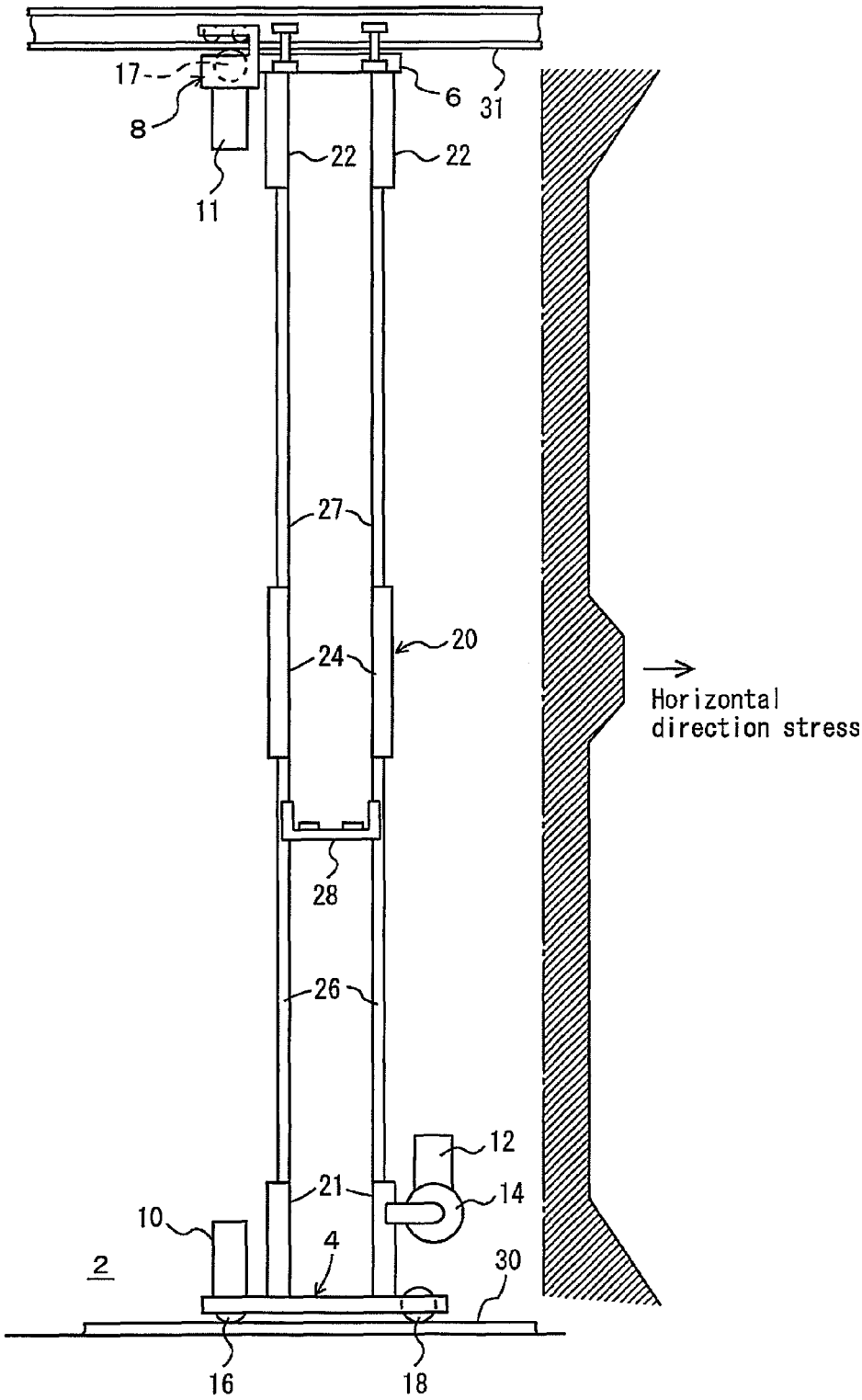
FIG. 1 is a side view showing a stacker crane according to an embodiment.

2: stacker crane
4: lower vehicle
6: upper frame
8: upper vehicle
10, 11: travel motor
12: elevation motor
14: drum
16, 17: drive wheel
18: driven wheel
20: mast
21, 22: end portion
24: central portion
26, 27: intermediate portion
28: elevation frame
30, 31: travel rail
32: slide fork
33: bracket
34: flange
36: center rail
38 to 40: side rail
46, 49: guide roller
44, 48: bracket
50 to 53: guide surface
54: bolt
56: opening
58, 59: bracket
F: reference surface

DETAILED DESCRIPTION OF THE INVENTION

FIGS. 1 to 7 show a stacker crane 2 according to an embodiment. A reference numeral 4 denotes a lower vehicle, a reference numeral 6 denotes an upper frame, and a reference numeral 8 denotes an upper vehicle. A reference numeral 10 denotes a travel motor provided in the lower vehicle 4. A reference numeral 11 denotes a travel motor provided in the upper vehicle 8. A reference numeral 12 denotes an elevation motor, and a reference numeral 14 denotes a drum for elevating or lowering an elevation frame 28 by winding or unwinding a suspension member (not shown). Drive wheels 16, 17 are operated by the travel motors 10, 11 for allowing the stacker crane 2 to travel along travel rails 30, 31. A reference numeral 18 denotes a driven wheel.

In the embodiment, the upper frame 6 and the upper vehicle 8 are provided separately because the stacker crane 2 can be provided at a low position by pushing or drawing the upper frame 6 by the upper vehicle 8. Alternatively, an upper end of the mast 20 may be supported directly by the upper vehicle 8 without providing the upper frame 6. Structure of the lower vehicle 4, structure of the upper vehicle 8, and structure of the upper frame 6 can be determined arbitrarily. In the embodiment, two support columns provided at front and back positions in the travel direction of the elevation frame 28 are used as the mast. Alternatively, the mast 20 may be made up of only one support column, or three or four support columns. As long as the mast 20 is capable of connecting the upper and lower vehicles 4, 8, and standing between the upper and lower vehicles 4, 8 by itself, the number of support columns of the mast 20 is not limited. Preferably, the mast 20 includes a plurality of support columns. In particular, it is preferable that the mast 20 includes a plurality of support columns provided at front and back positions in the travel direction of the elevation frame 28. In this specification, a surface of the mast 20 facing the elevation frame 28 is defined as the front surface, and a surface of the mast 20 opposite to the elevation frame 28 is defined as the back surface, and two left and right surfaces in the travel direction of the stacker crane 2 are defined as the side surfaces.

Each of the pair of front and back support columns of the mast 20 is formed by connecting (i) a lower end portion 21, (ii) a lower intermediate portion 26, (iii) a central portion 24 in the height direction, (iv) an upper intermediate portion 27, and (v) an upper end portion 22, in the order from the lower vehicle 4 to the upper frame 6. The upper and lower end portions 21, 22 are rectangular pipes of the same steel material. Therefore, the upper and lower end portions 21, 22 have the same strength. However, this is not essential. The upper and the lower end portions 21, 22 may have different strengths. As for proportions of the these portions in the total height of the mast 20, the upper and lower end portions 21, 22 are, e.g., about 10%, respectively, the central portion 24 is, e.g., about 10%, and the intermediate portions 26, 27 are, e.g., about 30%, respectively.

Figure 2:
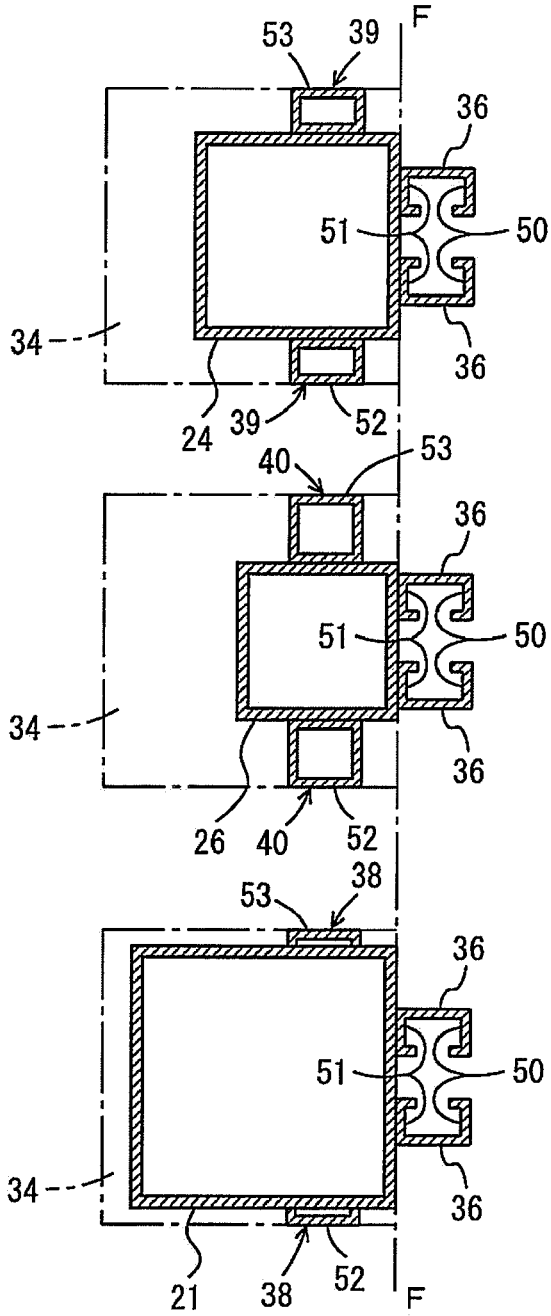
FIG. 2 shows cross sections of columns of a mast in the embodiment, and showing in the order of upper and lower end portions, lower and upper intermediate portions in the height direction, and a central portion in the height direction.
Figure 3:
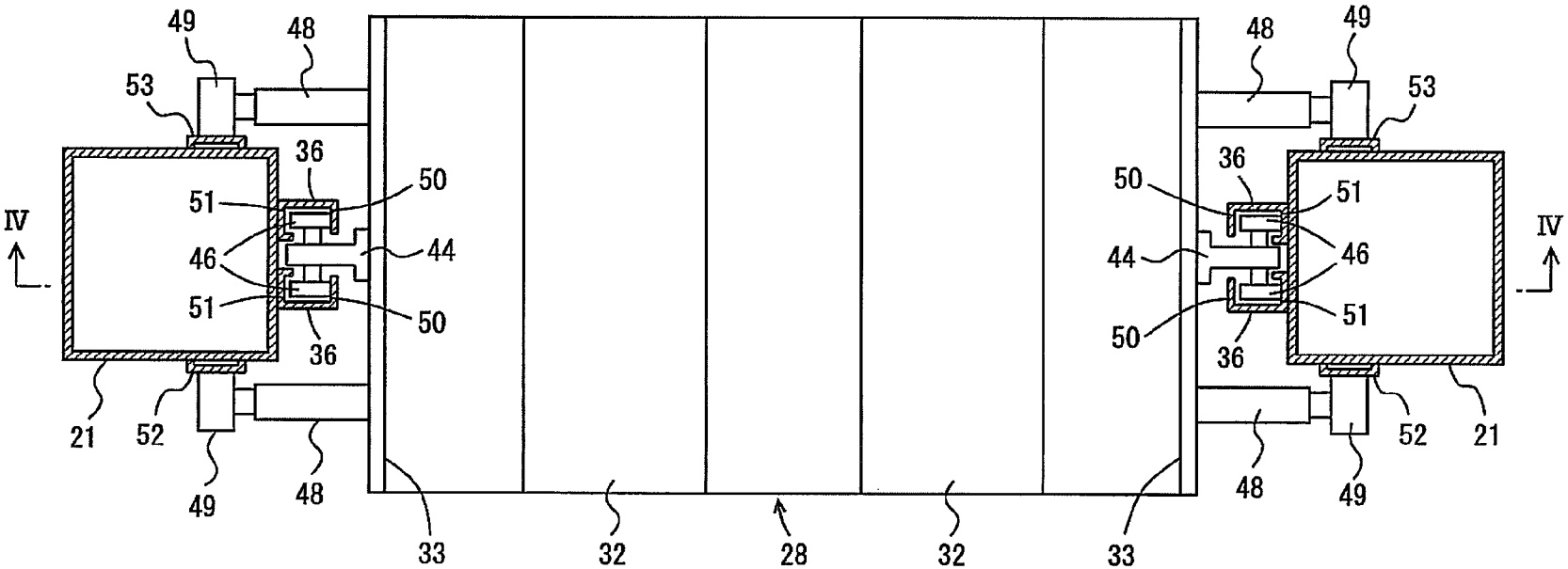
FIG. 3 is a plan view showing a position of an elevation frame relative to the mast in the embodiment.

FIG. 2 shows cross sections of the end portion 21, the lower intermediate portion 26, and the central portion 24. It should be understood that the upper end portion 22 and the lower end portion 21 have the same cross section, and the upper intermediate portion 26 and the lower intermediate portion 27 have the same cross section. The members 21, 26, 24 are rectangular steel pipes having the same thickness, and different cross sectional areas. For example, each of the members 21, 26, 24 has a square shape in cross section. In the structure, the end portion 21 has the highest strength, the intermediate portion 26 has the lowest strength, and the central portion 24 has the intermediate strength. Then, for providing left and right guide surfaces for the elevation frame 28, the front surfaces of the end portion 21, the intermediate portion 26, and the central portion 24 are provided on a same reference plane F in the vertical direction. Since the end portion 21, the intermediate portion 26, and the central portion 24 have different widths, the side surfaces of the end portion 21, the intermediate portion 26, and the central portion 24 cannot be used as guide surfaces. Therefore, side rails 38, 39, and 40 each formed in a rectangular pipe are provided on both of the left and right side surfaces of the end portion 21, the intermediate portion 26, and the central portion 24. Surfaces of the side rails 38, 39, and 40 protruding from the mast 20 are provided on the same plane along the vertical direction such that the elevation frame can be guided in a lateral (left-right) direction. The lateral direction herein means a direction perpendicular to the travel direction of the stacker crane in the horizontal plane. The above structure is adopted also in the intermediate portion 27 and the end portion 22.

For example, a pair of left and right center rails 36 are provided on the front surfaces of the members such as the end portion 21, the intermediate portion 26, and the central portion 24. In this respect, all of the members 21 to 27 have the common structure. For example, the center rail 36 has a gate shape, and two opposite surfaces inside the gate extending along the travel direction of the stacker crane are used as the guide surfaces 50, 51. For connecting the members 21 to 27 having different sizes, for example, a flange 34 shown in FIG. 2 is used.

FIGS. 3 to 7 show the relationship between the elevation frame 28 and the mast, taking the end portion 21 as an example. Reference numerals 32 denote slide forks, and reference numerals 33 denote brackets at both of front and back ends of the elevation frame 28. Reference numerals 46, 49 denote guide rollers, and reference numerals 44, 48 denote brackets for these guide rollers 46, 49. The brackets 44 extend from the central positions at both of front and back ends of the elevation frame 28, to the front side and the back side, and a pair of the guide rollers 49 are provided on both sides. The brackets 48 are provided at four corners of the elevation frame 28, and the guide rollers 49 are provided at front ends of the brackets 48.

Figure 4:
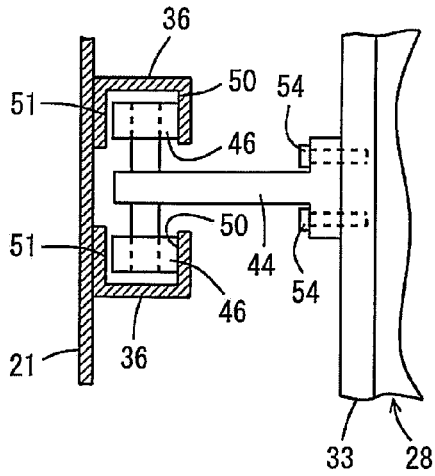
FIG. 4 is a partial enlarged plan view showing main components in FIG. 3.
Figure 5:
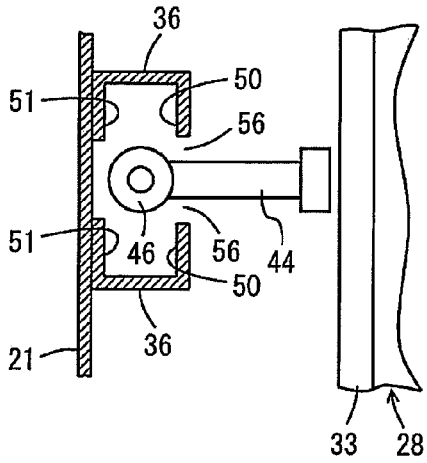
FIG. 5 is a partial enlarged plan view showing main components in a state where guide rollers are attached or detached.

FIG. 4 is an enlarged view showing an area around the center rails 36 and the bracket 44. The bracket 44 is attached to the bracket 33 by fastening members such as bolts 54. In the case where the guide rollers 46 are abraded, or in the case where new guide rollers 46 are attached inside the center rails 36, as shown in FIG. 5, the bracket 44 is rotated, e.g., 90° about the horizontal axis. Then, the guide rollers 46 are placed into, or taken out of the center rails 36 through an opening 56 between the center rails 36. In this manner, the guide rollers 46 can be placed into, or taken out of the center rails 36 easily.

Figure 6:
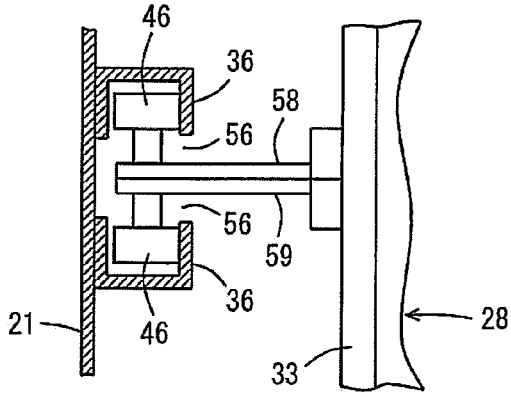
FIG. 6 is a partial enlarged plan view showing main components of a stacker crane according to a modified embodiment.

FIG. 6 is a view showing the manner of placing the guide rollers 46 into, or taking the guide rollers 46 out of the center rails 36 according to a modified embodiment. In the modified embodiment, the bracket 44 is made up of a pair of brackets 58, 59, and the brackets 58, 59 are fixed together using keys or bolts and nuts (not shown). Further, one of the pair of the guide rollers 46 is attached to the bracket 58, and the other of the pair of the guide rollers 46 is attached to the bracket 59. At the time of placing the guide rollers 46 into, or taking the guide rollers 46 out of the center rails 36, the bracket 44 is disassembled into brackets 58, 59. In this manner, the guide rollers 46 can be placed into, or taken out of the center rails 36 through the opening 56.

Figure 7:
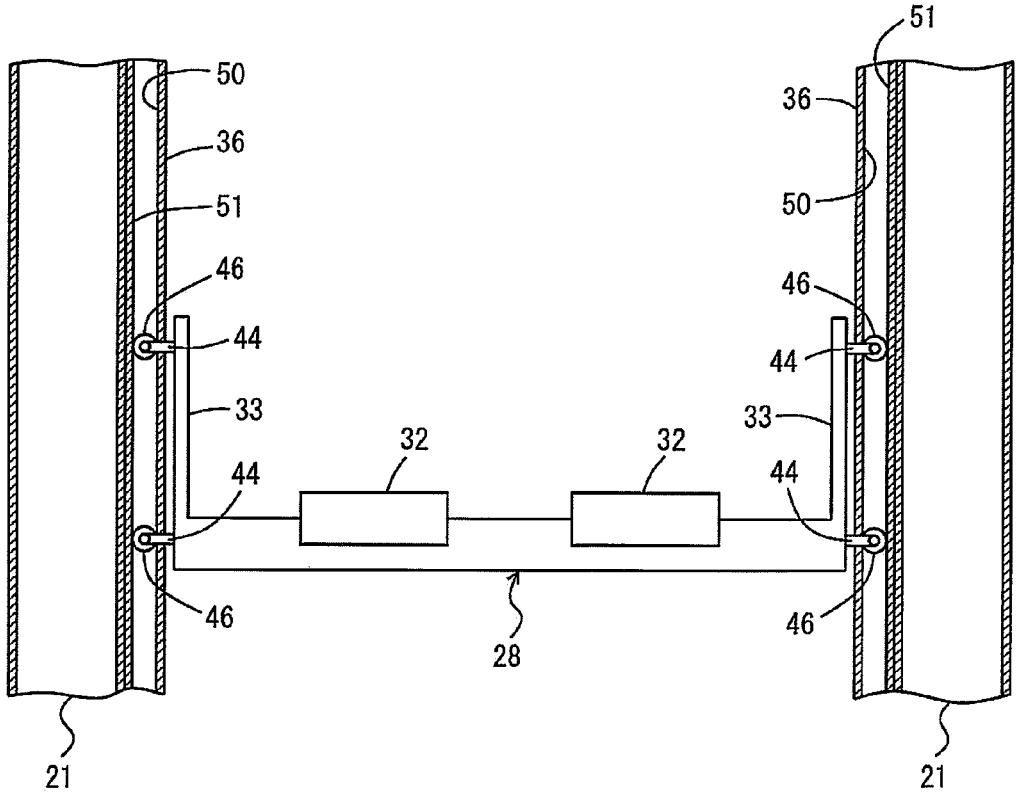
FIG. 7 is a vertical cross sectional view in a reduced scale in a direction indicated by a line IV-IV in FIG. 3.

As shown in FIG. 7, for example, the brackets 44 and the guide rollers 46 are provided in pairs along the height direction of the elevation frame 28. In total, four brackets 44 and eight guide rollers 46 are provided for one elevation frame 28. In this manner, the force applied from the elevation frame 28 to the mast is further dispersed, and the predetermined orientation of the elevation frame 28 relative to the mast is maintained.

Operation of the embodiment will be described. Travel motors 10, 11 are provided for the lower vehicle 4 and the upper vehicle 8, respectively. It is assumed that the travel motor 10 and the travel motor 11 have substantially the same output. The stress in the horizontal direction applied to the respective portions of the mast 20 when the mast 20 has the structure as in the case of the embodiment is shown on the right side in FIG. 1. The stress is generated by the forces applied from the vehicles 4, 8 to the mast 20, and the inertial force of the mast 20. The other forces applied to the mast 20 include the gravity by the weight of the mast 20 and the weight of the elevation frame 28. In comparison with the stress, the gravity can be supported easily. Additionally, a stress in the lateral direction during movement of a transfer apparatus of the elevation frame 28 is applied to the mast 20. This stress is small in comparison with the stress applied during traveling.

The stress applied to the upper and lower end portions 21, 22 is large because of connection to the vehicles 4, 8. Though the force applied to the central portion 24 is smaller than the force applied to the upper and lower end portions 21, 22, since the central portion 24 is not flexible, and needs be kept in a substantially straight shape, the force applied to the central portion 24 is large. The stress applied to the intermediate portions 26, 27 is the smallest. Therefore, by forming the respective members 21 to 27 to have different strengths in correspondence with these different stresses, weight reduction of the mast 20 is achieved. Thanks to the weight reduction of the mast 20, the inertial force is reduced, and further reduction in the strength required for the mast 20 is achieved advantageously.

In the embodiment, it is assumed that driving forces applied from the upper and lower vehicles 4, 8 to the mast 20 are equal. Therefore, the mast 20 is vertically symmetrical about the central portion 24. In the case where these driving forces are different, for example, in the case where the driving force from the lower vehicle 4 is larger than the driving force from the upper vehicle 8, the strength of the end portion 21 may be higher than the strength of the end portion 22, and the strength of the intermediate portion 26 may be higher than the strength of the intermediate portion 27. Also in this case, the end portions 21, 22 have the highest strength, the central portion 24 has the intermediate strength, and the intermediate portions 26, 27 have the lowest strength.

Next, front surfaces of the respective members 21 to 27 adjacent to elevation frame 28 are placed on the same vertical plane. In this manner, the elevation frame 28 can be guided in the front-back (travel) direction. Further, the side rails 38 to 40 are provided for the members 21 to 27, and the guide surfaces 52, 53 are provided along vertical surfaces of the side rails 38 to 40. In this manner, the elevation frame 28 can be guided also on both side surfaces of the mast. By reducing the width of the side rails 39, 40 in the lateral direction to some extent, the side rails 38 for the upper and the lower end portions 21, 22 may be omitted. Further, by changing the cross sectional shape of the central portion 24 from the square shape to a rectangular shape, the side rails 39 can be omitted. That is, the side rails are provided at least for the intermediate portions 26, 27.

Guide surfaces 50, 51 facing each other are provided inside the center rails 36. The guide rollers 46 are set inside the center rails 36 such that minute clearance is formed between the guide rollers 46 and the guide surfaces 50, 51. When an inertial force is applied to the elevation frame 28, both of the guide rollers 46 are guided by the center rails 36. For example, if the inertial force is applied to the right side in FIG. 3, in the left center rails, the guide rollers contact the guide surface 50, and in the right center rails, the guide rollers contact the guide surface 51. In the structure, the inertial force applied to the elevation frame 28 can be received by the left and right support columns of the mast. That is, one support column supports about ½ of the force applied to the mast.

Further, since the pair of the left and right guide rollers 46 are provided, the pressure applied to the surfaces of the guide rollers 46 is reduced, and the force applied from the elevation frame 28 to the mast is dispersed. Further, even if the elevation frame 28 is deformed for some reasons, the deformation can be suppressed also by guide rollers 46, in addition to the guide rollers 49.

In the embodiment, the following advantages are obtained.

(1) By providing strength distribution in the height direction of the mast in correspondence with the horizontal stress applied to the mast 20, weight reduction of the mast 20 is achieved. As a result, the stacker crane 2 can travel at high speed easily.

(2) Though the cross sectional shape of the mast 20 is not uniform along the height direction, by providing the surfaces of the respective member 21 to 27 adjacent to the elevation frame 28 on the same vertical plane, the elevation frame 28 can be guided in the front-back direction. Further, by providing the side rails 38 to 40 for the respective members 21 to 27, and providing the common guide surfaces 52, 53, the elevation frame 28 can be guided also by both of the left and right side surfaces.

(3) By providing the center rails 36 having the pair of front and back guide surfaces 50, 51 on the surface of the mast 20 adjacent to the elevation frame, the inertial force applied to the elevation frame can be received by the both of the left and right support columns of the mast. Thus, further weight reduction of the mast is achieved.

(4) By attaching the pair of guide rollers 46 to the bracket 44, the guide rollers 46 can be placed into, or taken out of the center rails 36 easily.

(5) By providing the pair of left and right center rails 36 for each of the support columns, and providing the pair of left and right guide rollers 46 for the bracket 44 facing the elevation frame 28, the pressure applied to the surfaces of the guide rollers is reduced, and no force is locally applied to the mast.

(6) By providing a plurality of brackets 44 and a plurality of guide rollers 46 along the height direction of the elevation frame 28, the elevation frame 28 can be supported further stably.

The invention claimed is:

1. A stacker crane, comprising:

upper and lower vehicles each having at least a travel motor;

a mast disposed between said upper and lower vehicles, said mast including upper and lower end portions, a central portion, and intermediate portions between each of said upper and lower end portions and said central portion, said mast having non-uniform cross-sectional area at positions along a height direction thereof;

an elevation frame elevating and lowering along said mast a central rail provided on a facing surface of said mast which faces said elevation frame, said central rail having two opposite guide surfaces facing each other on an inside thereof; and a plurality of hollow pipes on opposite side surfaces of said mast which are orthogonal to said facing surface, said plurality of hollow pipes each having a guide surface which is in a same plane from the lower end portion to the upper end portions, wherein said elevation frame includes at least a first guide roller, guided by said two opposite guide surfaces of said central rail of said mast, and second guide rollers, guided by said guide surfaces of said hollow pipes, wherein the cross-sectional area of said upper and lower end portions is greater than the cross-sectional area of said central portion and the cross-sectional area of said central portion is greater than the cross-sectional area of the intermediate portions, and wherein said facing surface is in a same plane from the lower end portion to the upper end portion.

2. A method of reducing weight of a mast of a stacker crane, comprising:

providing lower and upper vehicles each having at least a travel motor;

providing a mast disposed between said upper and lower vehicles, said mast including upper and lower end portions, a central portion, and intermediate portions between each of said upper and lower end portions and said central portion, said mast having non-uniform cross-sectional area at positions along a height direction thereof;

providing an elevation frame elevating and lowering along said mast;

providing a central rail provided on a facing surface of said mast which faces said elevation frame, said central rail having two opposite guide surfaces facing each other on an inside thereof; and providing a plurality of hollow pipes on opposite side surfaces of said mast which are orthogonal to said facing surface, said plurality of hollow pipes each having a guide surface which is in the same plane from the lower end portion to the upper end portions, wherein said elevation frame includes at least a first guide roller, guided by said two opposite guide surfaces of said central rail of said mast, and second guide rollers, guided by said guide surfaces of said hollow pipes, wherein the cross-sectional area of said upper and lower end portions is greater than the cross-sectional area of said central portion and the cross-sectional area of said central portion is greater than the cross-sectional area of the intermediate portions, and wherein said facing surface is in a same plane from the lower end portion to the upper end portion.

* * * * *